United States Patent [19]

Schädlich et al.

[11] 4,382,458

[45] May 10, 1983

[54] PLANING TOOL

[75] Inventors: Fritz Schädlich, Leinfelden-Echterdingen; Gerhard Armbruster, Stuttgart; Klaus-Dieter Jaspert, Filderstadt, all of Fed. Rep. of Germany

[73] Assignee: Robert Bosch GmbH, Stuttgart, Fed. Rep. of Germany

[21] Appl. No.: 167,326

[22] Filed: Jul. 10, 1980

[30] Foreign Application Priority Data

Oct. 5, 1979 [DE] Fed. Rep. of Germany ..... 2940398

[51] Int. Cl.[3] ..... B27G 13/04

[52] U.S. Cl. ..... 144/230; 144/117 R; 144/241

[58] Field of Search ..... 144/114 R, 117 R, 117 A, 144/228, 230, 241, 117 C; 407/5, 37, 38, 39, 41, 49, 45; 145/4, 4.2

[56] References Cited

U.S. PATENT DOCUMENTS

| | | | |
|---|---|---|---|
| 1,269,378 | 6/1918 | Bunch | 144/230 |
| 2,836,206 | 5/1958 | Gaskell | 144/117 R |
| 3,014,511 | 12/1961 | Kirsten | 144/230 |
| 3,785,417 | 1/1974 | Vora | 144/230 |
| 3,989,077 | 11/1976 | Humbert | 144/230 |

FOREIGN PATENT DOCUMENTS

| | | | |
|---|---|---|---|
| 2462340 | 10/1976 | Fed. Rep. of Germany | 144/230 |

*Primary Examiner*—W. D. Bray

*Attorney, Agent, or Firm*—Michael J. Striker

[57] ABSTRACT

A planing tool has a cylindrical body with elongated axially extending grooves in which elongated inserts with planing members are received, adjusting screws extending in a radial direction and arranged to adjust the radial distance of the inserts from the axis of rotation of the body, clamping screws arranged to clamp the inserts in the elongated grooves, wherein each adjusting screws extends through an opening of the respective insert with play, and a spring element is located between a bottom wall of each of the grooves and a respective one of the inserts.

12 Claims, 4 Drawing Figures

PLANING TOOL

BACKGROUND OF THE INVENTION

The present invention relates to a planing tool, particularly for a manual planing machine. Planing tools or rolls are known in the art. In a known planing tool the adjustment of planing members is performed with the aid of set screws which are screwed in threaded holes of inserts and abut with their ends against bottom walls of longitudinal grooves which are provided in the body of the tool and receive the inserts. When in such a construction clamping screws are released for replacement or exchange of the planing members, the inserts together with the planing members and holders can be withdrawn from the body or unintentionally dropped out. When simultaneously, two or more planing members are replaced or exchanged, it can happen that the inserts protruding out of the body of the tool will be interchanged with one another and inserted during subsequent setting in another longitudinal groove. Thereby, the exact adjustment of the edges of the planing members relative to the axis of rotation of the tool body is lost. Furthermore, in the known planing tools the elongated grooves provided in the body have a cross-section reduced in a wedge-shaped manner so as to prevent withdrawal of the inserts from the elongated grooves in radial direction under the action of centrifugal forces. In such a construction, during adjustment of the planing members, a lateral play between the inserts and the longitudinal grooves is available, and the inserts can be inserted into the longitudinal grooves only from the sides of the latter. Because of the wedge-shaped profile of the longitudinal grooves, it is not guaranteed that when the clamping screws are tightened, the adjusting screws abut against the bottom of the elongated grooves and the planing member be fixed exactly against the tool body.

SUMMARY OF THE INVENTION

Accordingly, it is an object of the present invention to provide a planing tool which avoids the disadvantages of the prior art.

More particularly, it is an object of the present invention to provide a planing tool in which, when clamping screws are released for the purpose of replacement or exchange of planing members, inserts which carry the planing members cannot be withdrawn from a tool body, inasmuch as they are undetachably retained in their elongated grooves by adjusting screws.

In keeping with these objects and with others which will become apparent hereinafter, one feature of the present invention resides, briefly stated, in a planing tool in which an adjusting screw extends through a throughgoing opening formed in an insert which carries a planing member, and a spring element extends between a bottom wall of a groove in which the insert is received and the respective insert. In such a construction, when the clamping screw is released for replacement or exchange of the planing members, the insert cannot be withdrawn from the tool body since it is retained by the adjusting screw in its elongated groove. The spring element presses the insert outwardly against a head or a flange of the adjusting screw and makes easier the adjustment, or replacement or exchange of the planing member. After the adjustment, the planing tool can rotate about its axis until the clamping screw is sufficiently accessible, and the adjusting screw in cooperation with the spring element retains the insert in the adjusted position. The inserts can be inserted into the tool body for mounting the tool in the machine housing, without fixedly tightening of the clamping screws.

In accordance with another advantageous feature of the present invention, each elongated groove may have two lateral flanks which are substantially parallel to one another, and embrace respective one of the inserts together with a respective one of the planing members and holding members, with small play. In this case, the inserts can be inserted radially into the tool body. Moreover, during the adjustment of the planing members, a considerable lateral play of the inserts in the elongated grooves does not take place.

In accordance with a still further advantageous feature of the present invention, an especially price-favorable construction may be provided when the inserts are formed as cast members with unworked outer faces. The holding members can be formed as stamped sheet metal parts which are secured against lateral and radial displacement by connection with the respective inserts via a plug connection. On the other hand, they may be formed as sheet metal angles inserted below the cast inserts.

The spring elements arranged under the inserts may be formed by cup springs coaxial with the adjustment screws or by flat springs extending in direction of elongation of the inserts.

After the adjustment, the screws may be secured against rotation by applying safety varnish or filling up the depressions which receive the screw heads.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
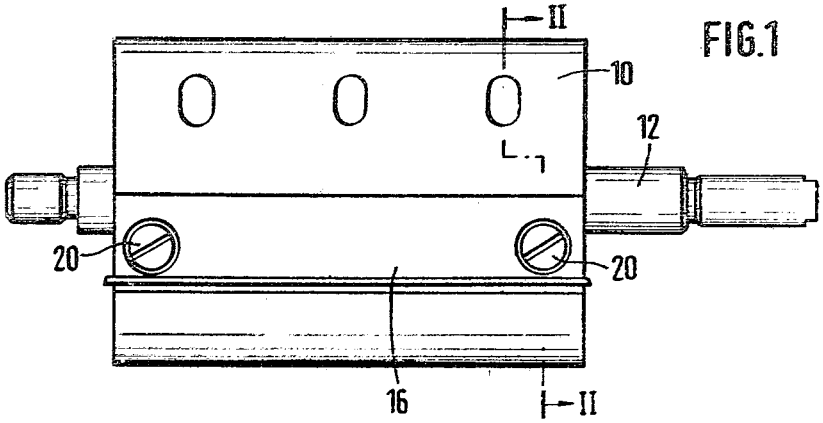
FIG. 1 is a side view of a planing tool in accordance with the present invention.
Figure 2:
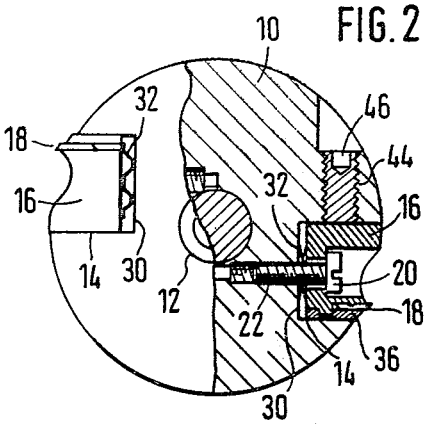
FIG. 2 is a partially sectioned end view of the planning tool of FIG. 1, with the section taken along the line II—II in FIG. 1.
Figure 3:
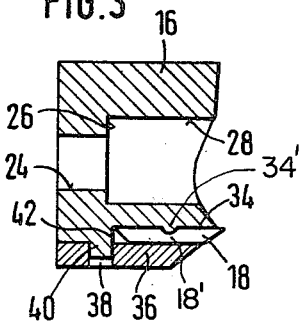
FIG. 3 is a view showing an enlarged section of an insert of the planing tool of FIGS. 1 and 2.

A planing tool or roll has a roll body 10 which is fixedly mounted on a driving shaft 12. Two elongated grooves 14 are provided in the body 10, and elongated inserts 16 are received in the grooves 14 as shown in FIGS. 1-3. The inserts 16 carry planing members or knives 18.

Two screws having cylindrical heads 20 are provided for holding the inserts 16 in the body 10. A shaft 22 of each screw 20 extends through a throughgoing opening 24 in the respective insert 16. A shoulder 26 extends between the opening 24 and an opening 28 of a greater cross-section. The opening 28 serves for receipt of the head of the respective screw 20 so that the head is sunk in the opening 28.

A spring element 32 is arranged between each insert 16 and a bottom 30 of the respective elongated groove 14 of the body 10. The spring element 32 may be formed as a cup spring which is coaxial with the respective screw 20. On the other hand, the spring element 32 may be formed as a flat spring which extends in direction of elongation of the respective insert 16.

Each insert 16 has an outside portion 34 with a bottom face against which the respective planing member 18 abuts. A holding member 36 is also located in the outside portion 34 of the lateral wall of the respective insert 16. The holding member 36 is a stamped part and provided with two perforations 38 which are spaced from one another in an axial direction. Each insert 16 has respectively arranged projections 40 which are complementary to and engage in the perforations 38 of the respective holding member 36.

A shoulder 42 extends between the bottom of the outside portions 34 and the outer lateral wall of the insert 16. The planing member 18 abuts against the shoulder 42. The depth of the outside portion 34 is somewhat smaller than the thickness of the planing member 18, so that the holding member 36 can be unobjectionably pressed against the planing member 18 through the respective wall portion. Each elongated groove 14 of the body 10 has two lateral flanks which embraces with movement play the inserted insert 16 together with the planing member 18 and the holding member 34.

Three clamping screws 44 are arranged tangentially to the axis of rotation of the body 10, for each insert 16. Each clamping screw 44 has a front end face which abuts against the respective insert 16, and a rear end face which is provided with an inner hexagon 46 for engaging by an auxiliary tool.

In order to assemble the planing tool, the insert 16 with the respective planing members 18 and holding members 36 are first assembled and inserted together with the spring elements 32 in the elongated grooves 14 of the body 10. Then the adjusting screws 20 and the clamping screws 44 are so screwed into the body 10, that the above-mentioned parts are held in the body without play. After this premounting, the planing tool is inserted into the housing of the machine and after this the adjustment of the planing members 18 relative to the bent face of the planing machine is performed. During this step the spring elements 32 continuously press the inserts 16 against the heads of the adjusting screws 20, and the lateral flanks of the elongated grooves guarantee a thorough play-free parallel guidance of the inserts. After the adjustment, the clamping screws 44 are tightened and thereby the planing members 18 are clamped in their adjusted position. Interengaging projection 34' on the insert 16 and groove 18' on the planing member 18 prevent radial movement of the latter.

In the event of replacement or exchange of the planing member 18, it suffices to release the clamping screws 44, whereafter the planing member 18 can be laterally withdrawn from a recess formed between the depressed portion of the insert 16 and the holding member 36. The inserts 16, are however retained in the elongated grooves 14 of the body 10 by the adjusting screws 20, so that an interchangement of the inserts 16 and a false subsequent insertion of them into the elongated grooves 14 are not possible. Then, a new planing member 18 can be laterally inserted into the recess formed between the depressed portion of the insert 16 and the holding member 36.

Figure 4:
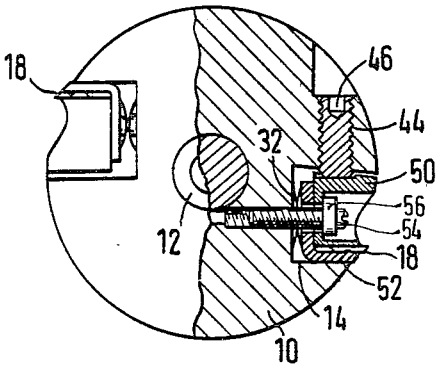
FIG. 4 is a partially sectioned end view of the planing tool in accordance with a second embodiment of the invention.

The planing tool shown in FIG. 4 somewhat differs from the planing tool of FIGS. 1–3. It has inserts 50 which are inserted in the elongated grooves 14 of the body 10, but do not have depressed portions of lateral walls. Sheet angles 52 are arranged on lateral walls of the inserts 50 so as to hold the planing members 18.

Screws 54 with flanges 56 are secured against rotation after the adjustment by varnish or filling substance. Instead of the screws with cylindrical heads or flanges, screws with heads or flanges of other shapes may be utilized.

The spring elements arranged under the inserts may be formed as helical compression springs. The elongated grooves for receiving the inserts may have a cross-section which decreases outwardly in a wedge-shaped member, in order to provide for additional securing against radial withdrawal of the inserts out of the elongated grooves. In this case, the lateral flanks of the elongated grooves, which faces away from the clamping screws, extend normal to the clamping screws.

It will be understood that each of the elements described above, or two or more together, may also find a useful application in other types of constructions, differing from the types described above.

While the invention has been illustrated and described as embodied in a planing tool, particularly for a planing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A planing tool, particularly for a manually operable planing machine, comprising a body having an axis of rotation, a peripheral surface and a plurality of elongated grooves on said peripheral surface, said grooves extending substantially in an axial direction and being spaced from one another in a circumferential direction, each of said grooves being limited by a bottom wall; a plurality of elongated inserts each carrying an elongated planing knife and inserted in a respective one of said grooves; adjusting means arranged to adjust the radial distance between said inserts and said axis of rotation of said body, said adjusting means including a plurality of adjusting screws each extending in a substantially radial direction and having a projection; clamping means arranged to clamp said inserts in said grooves of said body, said clamping means including a plurality of clamping screws each movable between a clamping position in which it clamps one of said inserts in a respective one of said grooves, and unclamping position in which it releases the same so that said insert can be withdrawn from said one groove; means for receiving each of said adjusting screws, said receiving means including a through-going opening formed in each of said inserts so that each of said adjusting screws can extend through a respective one of said opening with play, and a threaded hole formed in said body so that each of said adjusting screws can be threaded into a respective one of said threaded holes; and means for pressing each of said inserts against said projection of a respective one of said adjusting screws, said pressing means including at least one spring element extending between the bottom wall of each of said grooves and a respective one of said inserts.

2. A cutting tool as defined in claim 1, wherein said projection of each of said adjusting screws is formed as a screw head.

3. A cutting tool as defined in claim 1, wherein said projection of each of said adjusting screws is formed as a flange.

4. A cutting tool as defined in claim 1, wherein each of said grooves has two opposite flanks, each of said clamping screws extending through one of said flanks and pressing the respective insert against the other of said flanks of a respective one of said grooves.

5. A cutting tool as defined in claim 1, wherein the projection of each of said adjusting screws has a shoulder facing toward said body, each of said spring elements being arranged to press one of said inserts against the shoulder of the projection of a respective one of said adjusting screws.

6. A cutting tool as defined in claim 1, wherein each of said inserts has two lateral walls one of which has an outside portion with a bottom face; and further comprising a plurality of holding members each arranged at a lateral distance from the bottom of the outside portion of a respective one of said inserts so as to form a recess therebetween, each of said planing knives being arranged in a respective one of said recesses.

7. A cutting tool as defined in claim 6, wherein each of said grooves has two lateral flanks which embrace with play a respective one of said inserts together with the respective planing knife and holding member.

8. A cutting tool as defined in claim 7, wherein the lateral flanks of each of said grooves are substantially parallel to one another.

9. A cutting tool as defined in claim 1 wherein each of said inserts is a cast member with unworked outer faces.

10. A cutting tool as defined in claim 1, wherein each of said adjusting screws has an axis, each of said spring members being formed as a cup spring co-axial with a respective one of said adjusting screws.

11. A cutting tool as defined in claim 1, wherein each of said spring element is formed as a flat spring extending in direction of elongation of a respective one of said inserts.

12. A cutting tool as defined in claim 1, wherein each of said spring elements is formed as a helical compression spring.

* * * * *